US006534129B1

(12) United States Patent
Miller et al.

(10) Patent No.: US 6,534,129 B1
(45) Date of Patent: Mar. 18, 2003

(54) ELECTROSTATIC LIQUID DISPENSING APPARATUS AND METHOD

(75) Inventors: Scott R. Miller, Roswell, GA (US); Laurence B. Saidman, Duluth, GA (US); James W. Schmitkons, Lorain, OH (US); David Zgonc, Atlanta, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 10/021,157

(22) Filed: Oct. 30, 2001

(51) Int. Cl.[7] ..... B05D 1/04; B05C 5/00

(52) U.S. Cl. ..... 427/466; 427/458; 427/472; 427/483; 118/620; 118/624

(58) Field of Search ..... 427/458, 466, 427/472, 479, 480, 483, 485, 420; 118/624, 638, 50.1, 620, 629; 239/690, 695

(56) References Cited

U.S. PATENT DOCUMENTS

| | | | | |
|---|---|---|---|---|
| 3,093,309 A | | 6/1963 | Watanabe | 239/15 |
| 3,577,198 A | | 5/1971 | Beam | 346/75 |
| 3,911,161 A | | 10/1975 | Nord et al. | 427/30 |
| 3,939,800 A | | 2/1976 | Banker | |
| 4,142,010 A | | 2/1979 | Pipkin et al. | |
| 4,513,683 A | | 4/1985 | Kisler | |
| 4,749,125 A | | 6/1988 | Escallon et al. | 239/3 |
| 4,810,522 A | * | 3/1989 | Kisler | |
| 4,830,872 A | | 5/1989 | Grenfell | 427/30 |
| 4,904,174 A | | 2/1990 | Moosmayer et al. | 425/174.8 E |
| 5,085,891 A | | 2/1992 | Evans | |
| 5,086,973 A | | 2/1992 | Escallon et al. | 239/3 |
| 5,122,048 A | | 6/1992 | Deeds | 425/174.8 E |
| 5,332,154 A | | 7/1994 | Maier et al. | 239/3 |
| 5,421,921 A | | 6/1995 | Gill et al. | 156/62.4 |
| 5,441,204 A | | 8/1995 | Tappel et al. | 239/708 |
| 5,552,012 A | | 9/1996 | Morris et al. | |
| 6,368,675 B1 | * | 4/2002 | Louks et al. | |

FOREIGN PATENT DOCUMENTS

| | | |
|---|---|---|
| EP | 0194074 A1 | 9/1986 |

* cited by examiner

*Primary Examiner*—Fred J. Parker
(74) *Attorney, Agent, or Firm*—Wood, Herron & Evans, L.L.P.

(57) ABSTRACT

An apparatus and method for dispensing one or more liquid beads on a substrate utilizes a liquid dispenser with one or more liquid dispensing outlets and one or more movable electrostatic point sources. Liquid material dispensed from an outlet is attracted to, or otherwise electrostatically influenced by, the electrostatic point source(s) resulting in controlled placement of the liquid material on a substrate passing or positioned between the outlet(s) and the point source(s).

21 Claims, 3 Drawing Sheets

ELECTROSTATIC LIQUID DISPENSING APPARATUS AND METHOD

FIELD OF THE INVENTION

The present invention pertains to non-contact dispensing systems for dispensing one or more beads of liquid material onto a substrate, and more particularly to an electrostatic dispensing system for electrostatically dispensing such liquid material.

BACKGROUND OF THE INVENTION

During electrostatic dispensing operations, a liquid material is electrically biased relative to a target substrate to cause electrostatic attraction between the dispensed liquid material and the substrate for controlled deposition of the liquid material onto the substrate. Prior electrostatic applicators have used charging components directly in the dispensing outlet to create an electrostatic voltage potential between the liquid material being dispensed from the outlet and a grounded substrate. Other applicators, such as disclosed in U.S. patent application Ser. No. 09/429,821 of Borsuk et al., commonly owned by the assignee of the present invention, generate an electrostatic field from beneath a substrate, such as a moving nonwoven web of material. The outlet dispensing the liquid material is grounded to create a voltage potential and thereby cause the dispensed liquid material to be attracted to the substrate and applied in continuous straight lines on the substrate.

Notwithstanding the improvements over the prior art provided by Borsuk et al., further improvements in conventional electrostatic applicators are still desirable. For example, conventional electrostatic applicators of the prior art, including the electrostatic dispensing apparatus disclosed by Borsuk et al., are designed to apply a uniform pattern of dispensed liquid materials to a substrate such that the dispensed liquid materials are applied in straight-line beads. In some applications, it is desired to produce oscillating or other patterns of the dispensed liquid material including patterns in which adjacent beads of dispensed liquid material may overlap. This can be especially desirable in adhesive bead or fiber dispensing applications such as in various packaging operations or product manufacturing operations.

There is a continuing need for an electrostatic dispensing apparatus capable of controlling the placement of a dispensed liquid material onto a moving substrate to provide various patterns of the dispensed liquid material.

SUMMARY OF THE INVENTION

The present invention provides an electrostatic dispensing apparatus with the ability to control the placement of one or more beads of liquid, such as a hot melt adhesive, onto a substrate without requiring control or steering of the substrate itself and without requiring controlled movement of the liquid applicator or dispenser. The present invention may be used to control the position of the dispensed liquid bead(s) to form various patterns of the dispensed bead(s) on the substrate.

In one embodiment of the present invention, the electrostatic dispensing apparatus includes a liquid dispensing outlet and an electrostatic point source which is spaced from the liquid dispensing outlet. The term "point source," as used herein, is intended to identify structure capable of generating a localized electrostatic field. The electrostatic point source can be moved relative to the liquid dispensing outlet and can be charged to create a voltage potential between the electrostatic point source and the liquid dispensing outlet. As liquid is dispensed from a liquid dispensing outlet which is grounded, for example, it is attracted to the electrostatic point source. The liquid may be electrostatically influenced and thereby deflected during its travel to a substrate in other ways as well, such as by the introduction of secondary electrostatic fields or metallic elements to influence the primary electrostatic field.

The substrate is positioned between the outlet and the point source so that the liquid material dispensed from the outlet will be deposited on the substrate in a precise manner and/or in a specifically desired pattern. Preferably, the substrate moves past a stationary dispensing apparatus. The movement and location of the electrostatic point source may be controlled by any suitable method. For example, position control may be provided by a servo motor coupled to the point source, or by other suitable actuators.

In another embodiment of the present invention, the electrostatic dispensing apparatus includes a plurality of liquid dispensing outlets positioned to dispense a number of liquid beads or fibers onto a substrate which may be moving adjacent to the dispensing apparatus. The device further includes a plurality of electrostatic point sources respectively corresponding to the plurality of liquid dispensing outlets. The electrostatic point sources are aligned to correspond with the liquid dispensing outlets and can be moved to control the position of each of the dispensed liquid beads on the substrate. The electrostatic point sources may be provided on an elongated charging member having multiple extensions to create the individual electrostatic point sources. In a preferred embodiment, the electrostatic point sources are provided on an elongated member having a serrated or scalloped edge to form the individual point sources. The elongated member may be moved relative to the fixed liquid dispensing outlets to control the placement of the dispensed liquid material on the moving substrate.

In yet another embodiment of the present invention, the electrostatic point sources are provided on a rotatable charging rod having raised circumferential ridges disposed on an outer surface of the rod and arranged such that the ridges are positioned on the outer surface at an angle to the longitudinal axis of the rod. In this configuration, the charging rod may be rotated to create the effect of a point source at the position closest to the liquid dispensing outlets. In other words, with respect to the fixed liquid dispensing outlets, the ridges on the rotating rod act as oscillating electrostatic point sources.

In yet another aspect of the present invention, the electrostatic dispensing apparatus includes two or more rows of multiple liquid dispensing outlets positioned adjacent to one another. The electrostatic dispensing apparatus further includes two or more adjacent rows of multiple electrostatic point sources corresponding to each of the rows of liquid dispensing outlets. The rows of electrostatic point sources may be moved either in unison, in groups, or independently to control the placement of the dispensed liquid material on the substrate or to create patterns of the dispensed liquid material on the moving substrate. As illustrative examples, the rows of electrostatic point sources may be provided as either elongated members having serrated or scalloped edges to create the individual electrostatic point sources, or the point sources may be provided as ridges or projections on a charging rod, and the rod may be rotated as described above.

In another aspect of the present invention, a method for dispensing liquid material onto a moving substrate using an electrostatic dispensing apparatus having liquid dispensing outlets and moveable electrostatic point sources includes moving a substrate through a space between the liquid dispensing outlets and the electrostatic point sources. The apparatus dispenses liquid material from the outlets, and the electrostatic point sources generate electrostatic fields which attract the liquid material. The electrostatic point sources move relative to the liquid dispensing outlets to control placement of the liquid material on the moving substrate. During this process, the liquid material is deflected from its normal path out of the outlet by the applied electrostatic force of the point source.

These and other advantages, objectives and features of the invention will become more readily apparent to those of ordinary skill upon review of the following detailed description of an illustrative embodiment of the invention.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
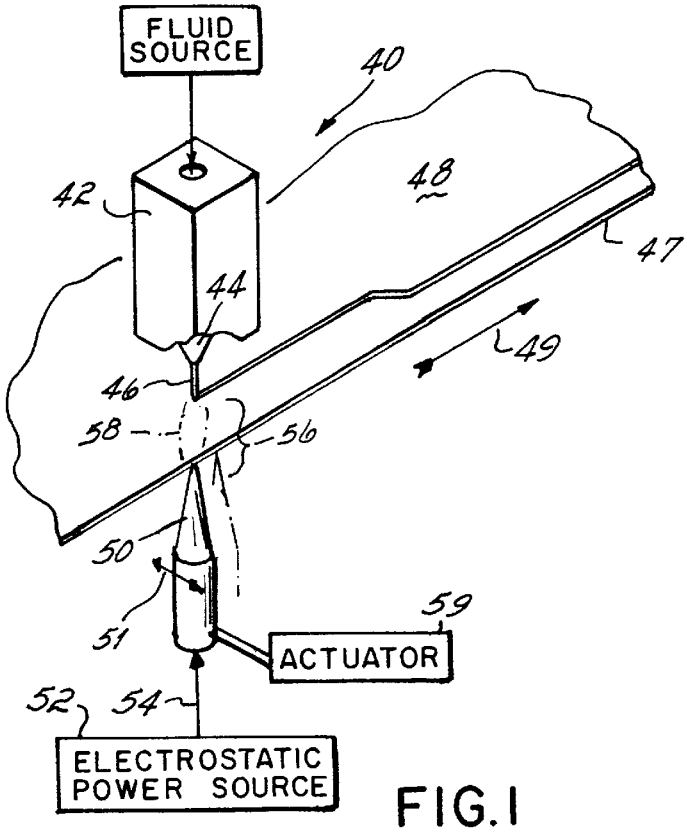
FIG. 1 is a partial perspective view of one embodiment of an electrostatic dispensing apparatus in accordance with the present invention and illustrating deflection of the dispensed liquid material with a single electrostatic point source.

Referring to FIG. 1 there is shown one embodiment of an electrostatic dispensing apparatus 40 incorporating the principles of the present invention. The electrostatic dispensing apparatus 40 includes a single liquid dispenser 42 having a single outlet 44 for dispensing flowable liquid material 46 onto a substrate 48 which is moving relative to the dispenser 42 in a direction represented by arrow 49. The apparatus 40 further includes a single electrostatic point source 50 which is connected to an electrostatic power source 52 by an electrostatic cable 54. The electrostatic point source 50 is spaced from the outlet 44 of the liquid dispenser 42 to define a space 56 through which a substrate 48 can pass. The electrostatic point source 50 is capable of generating a localized electric field 58 whereby liquid material 46 dispensed from the liquid dispensing outlet 44 is attracted towards the electrostatic point source 50 and is deposited on a portion of the moving substrate 48 that intersects the electric field 58 between the outlet 44 and the electrostatic point source 50.

The electrostatic dispensing apparatus 40 further includes an actuator 59 coupled to the point source 50 for imparting motion to the electrostatic point source 50. The actuator 59 may be any device capable of moving the electrostatic point source 50, such as a linear servo motor. In general, various known actuators may be used to move the point source 50 in a linear direction transverse to the direction 49 of the moving substrate 48 and represented by arrow 51. However, more complex motion of the actuator may be desired, as more fully explained below, and the invention is not limited to actuators for imparting purely linear motion to the point source.

Figure 2:
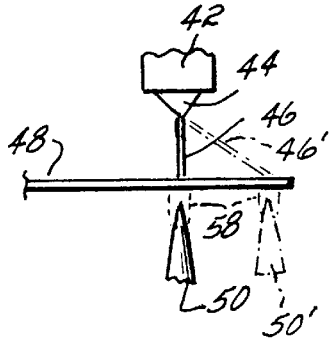
FIG. 2 is an elevation of the electrostatic dispensing apparatus of FIG. 1 illustrating deflection of the dispensed liquid material.

Because the dispensed liquid material 46 is attracted to the electrostatic point source 50, movement of the electrostatic point source 50, causes a displacement of the dispensed liquid material 46 relative to the substrate 48. This displacement of the dispensed liquid material 46 is illustrated in FIG. 2, where point source 50 is moved to a new position represented by 50' (shown in dashed lines) and the dispensed liquid material 46 correspondingly moves to a position represented by 46' (shown in dashed lines). In this manner, substantially precise placement of the liquid material 46 on the substrate 48 can be achieved by controlling the position of the electrostatic point source 50 relative to the fixed liquid dispensing outlet 44.

In one test conducted to determine the amount of liquid material displacement possible, displacements of ±7 mm and ±4 mm were measured at voltages of 60 kV and 29 kV, respectively, when the electrostatic point source was incrementally displaced ±20 mm from nominal position. The test was conducted using a Nordson H200 module with a single tooth ES tip and a 0.020-inch shim, a Nordson EPS9 ES power supply, and a Nordson Series 6000 Melter, all available from Nordson Corporation, Westlake, Ohio. The distance from the tip to the substrate was set at 2.034 inches and the distance from the substrate to the point source was set at 0.219 inch. Bostik Findley HX2712-02 adhesive, available from Bostik Findley, Wauwatosa, Wis., was dispensed at a rate of 2.4 g/min to 0.0015-inch thick clear polypropylene substrate moving at a line speed of 250 ft/min and the temperature of all zones was set at 275° F.

Figure 1A:
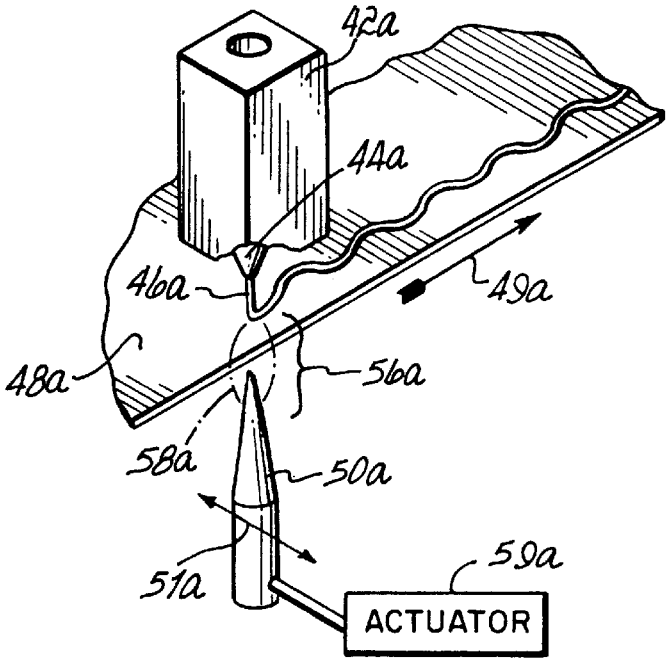
FIG. 1A is a perspective view of the electrostatic dispensing apparatus of FIG. 1 illustrating liquid material dispensed to form an oscillating pattern.
Figure 1B:
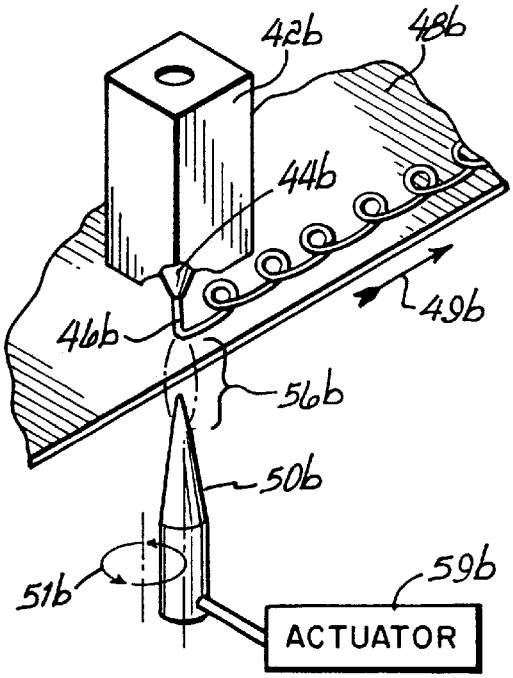
FIG. 1B is a perspective view of the electrostatic dispensing apparatus of FIG. 1 illustrating liquid material dispensed to form an overlapping pattern.

The moveable electrostatic point source 50 of the present invention is useful for controlling the placement of the dispensed liquid material 46 on the substrate 48, as illustrated in FIG. 1. In certain applications it may be desirable to create patterns of dispensed liquid material on a substrate 48. For example, an oscillating or overlapping pattern of dispensed liquid material 46 may be desired when the material is an adhesive, to achieve improved bonding of the substrate 48 with another material. The movable electrostatic point source 50 can be used to create such patterns through appropriate control of the actuator 59. FIG. 1A illustrates the dispensing of adhesive material 46*a* onto a moving substrate 48*a* in an oscillating pattern which may be achieved by utilizing the actuator 59*a* to reciprocate the point source 50*a* in a direction 51*a* transverse to the direction 49*a* of the substrate 48*a*. FIG. 1B illustrates an overlapping adhesive pattern which may be achieved by utilizing an actuator 59*b* capable of imparting an orbital motion 51*b* to the point source 50*b* in a plane substantially parallel to the substrate 48*b*. These examples illustrate just a few of the many patterns that are possible by controlling the motion of the point source 50 with the actuator 59 and the invention is not limited to the patterns disclosed.

A test conducted to determine dynamic response characteristics of dispensed liquid adhesive to an oscillating point source indicated that the adhesive effectively tracked the motion of the point source up to frequencies of at least 7.3 Hz. The test also indicated that line speed had a negligible effect on effective adhesive placement, but that adhesive flow did affect displacement, resulting in decreased displacement with increased adhesive flow rates. The test was conducted using a Nordson H200 module with a single tooth ES tip and a 0.020-inch shim, a Nordson EPS9 ES power supply, and a Nordson Series 6000 Melter, all available from Nordson Corporation, Westlake, Ohio. The distance from the tip to the substrate was set at 2.034 inches and the distance from the substrate to the point source was set at 0.219 inch. Bostik Findley HX2712-02 adhesive, available from Bostik Findley, Wauwatosa, Wis., was dispensed at a rates of 5.0 g/min and 9.5 g/min to 0.0015-inch thick clear polypropylene substrate moving at a line speeds of 100, 250, and 500 ft/min. Voltages ranging from 29 kV to 75 kV were tested and the temperature of all zones was set at 275° F.

It is further contemplated that the dispensed liquid material may be displaced without physically moving the point source, but by influencing the localized electrostatic field to effectively shift the field. This may be accomplished by the introduction of a metallic element or secondary electrostatic field generators in the vicinity of the localized electrostatic field to cause the dispensed liquid material to be deflected to a desired location on the substrate.

Figure 3:
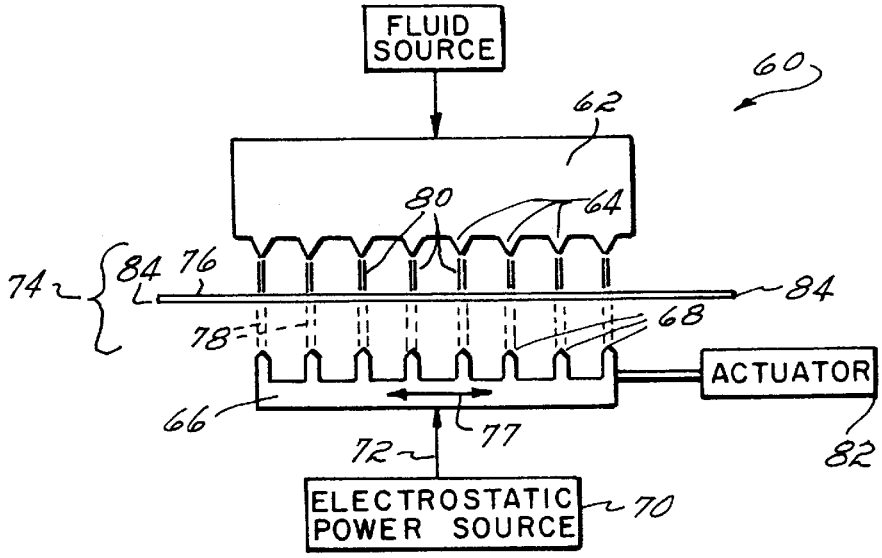
FIG. 3 is a schematic illustration of another embodiment of an electrostatic dispensing apparatus in accordance with the present invention and illustrating multiple electrostatic point sources.

Referring to FIG. 3, another embodiment of an electrostatic dispensing apparatus 60 incorporating the principles of the present invention includes a liquid dispenser 62 having multiple liquid dispensing outlets 64. In this embodiment, the electrostatic dispensing apparatus 60 includes an electrostatic charging bar 66 having multiple point sources 68, with each point source 68 corresponding to a liquid dispensing outlet 64 of the dispenser 62. The electrostatic charging bar 66 is connected to a power source 70 via an electrostatic cable 72. The multiple point sources 68 on the electrostatic charging bar 66 are created by serrated or scalloped edges of the electrostatic charging bar 66, which define individual electrostatic point sources 68. The electrostatic charging bar 66 is spaced from the liquid dispensing outlets 64 to define a space 74 through which a substrate 76, moving in a direction normal to the plane of the figure, may pass between the electrostatic charging bar 66 and the liquid dispensing outlets 64. The electrostatic charging bar 66 is capable of generating a series of localized electric fields 78 about the individual point sources 68 whereby liquid material 80 dispensed from the outlets 64 is attracted to the corresponding electrostatic point sources 68 through the localized electrostatic fields 78. The electrostatic charging bar 66 is coupled to an actuator 82 which may be a linear servo motor or other actuator, whereby translational motion 77 may be imparted to the electrostatic charging bar 66 relative to the fixed liquid dispensing outlets 64. In this manner, liquid 80 dispensed from the outlets 64 may be deposited on the moving substrate 76 in a substantially precise manner by controlling the position of the electrostatic charging bar 66 relative to the fixed liquid outlets 64.

The electrostatic dispensing apparatus 60 may also be used to create patterns of multiple lines of dispensed liquid material 80, such as oscillating or overlapping patterns, by moving the electrostatic charging bar 66 in reciprocating or orbital motions as described above for the single point source apparatus 40. Alternatively, charging bar 66 could be split up into independently movable point sources or groups of point sources, as desired.

Figure 4:
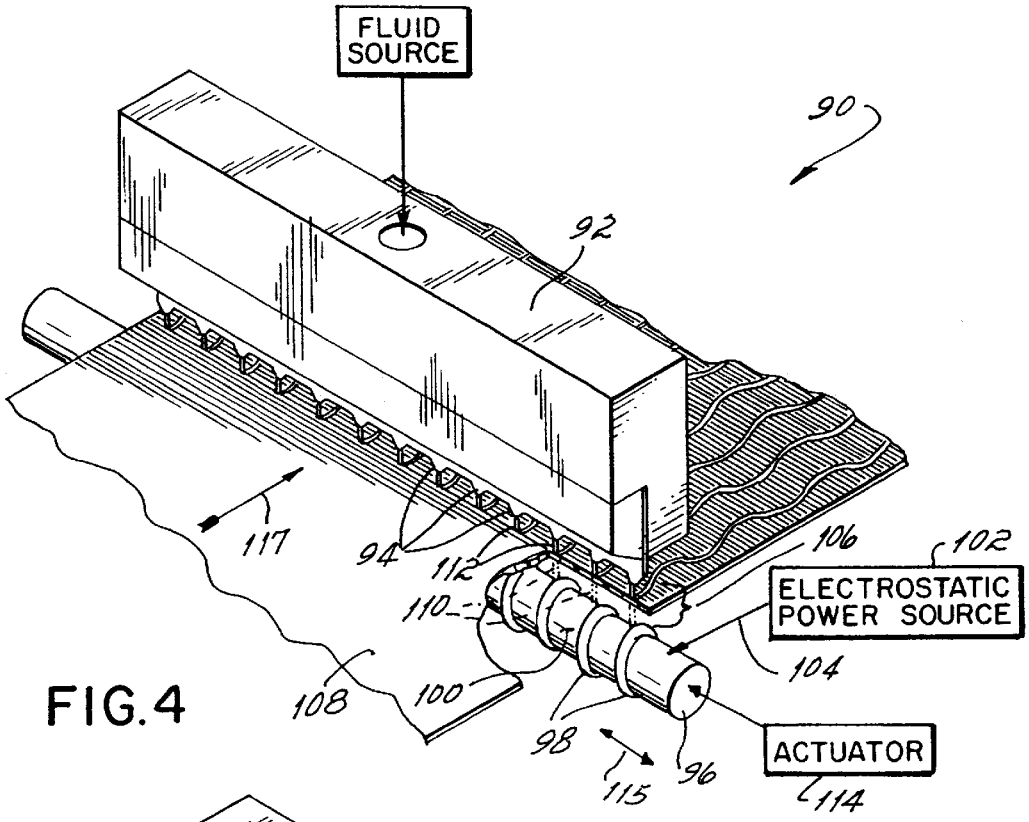
FIG. 4 is a perspective view of an embodiment of an electrostatic dispensing apparatus of the present invention depicting an alternative form of providing electrostatic point sources.

FIG. 4 shows another embodiment of an electrostatic dispensing apparatus 90 incorporating principles of the present invention for creating oscillating patterns of dispensed liquid material on a moving substrate. The apparatus 90 includes a liquid dispenser 92 having multiple liquid dispensing outlets 94 and an electrostatic charging bar in the form of an elongated rod 96. The rod 96 is cylindrical and has raised circumferential ridges 98 disposed on an outer surface 100 of the rod 96 and is connected to an electrostatic power source 102 by an electrostatic cable 104. The raised circumferential ridges 98 define the electrostatic point sources and are arranged along the rod 96 to correspond to the liquid dispensing outlets 94.

The rod 96 is spaced from the liquid dispensing outlets 94 to define a space 106 through which a moving substrate 108 may pass. The raised circumferential ridges 98 create localized electrostatic fields 110 which attract the liquid material 112 dispensed from corresponding liquid dispensing outlets 94 to be deposited on the moving substrate 108 as it passes between the outlets 94 and the rod 96. An actuator 114 coupled to the rod 96 moves the rod 96 whereby the dispensed liquid material 112 may be deposited onto the moving substrate 108 to create a desired pattern of dispensed material 112. For example, the actuator 114 may reciprocate the rod 96 in a linear direction 115 transverse to the direction 117 of the substrate 108 to create oscillating patterns of adhesive on the moving substrate, as depicted in FIG. 4. Alternatively, the actuator may move the rod in an orbital motion to create overlapping patterns of adhesive (not shown) on the substrate 108, as was described above with respect to FIG. 1B and single dispenser 42*b*.

In a preferred embodiment, the raised circumferential ridges 98 are arranged on the rod 96 at an angle to the longitudinal axis of the rod 96 and the actuator 114 is a rotary actuator adapted to rotate the rod 96. In this arrangement the raised circumferential ridges 98 on the rotating rod 96 act as oscillating point sources relative to the fixed liquid dispensing outlets 94. As depicted in FIG. 4, as the substrate 108 passes between the dispenser 92 and the rotating rod 96, dispensed liquid material 112 is deposited on the substrate 108 in an oscillating pattern.

Figure 5:
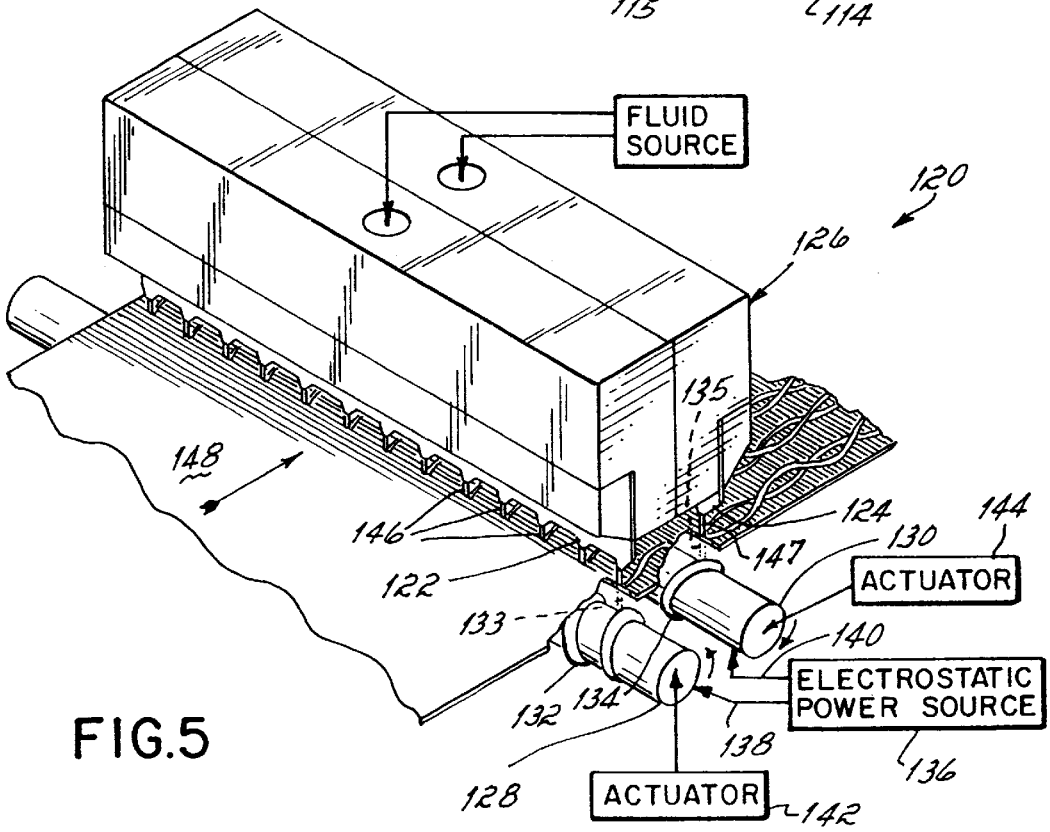
FIG. 5 is a perspective view of an electrostatic dispensing apparatus in accordance with the present invention depicting multiple rows of dispensing outlets and corresponding electrostatic point sources.

Referring to FIG. 5, another embodiment of an electrostatic dispensing apparatus 120 incorporating principles of the present invention is shown. The electrostatic dispensing apparatus 120 includes two rows of liquid dispensing outlets 122, 124 aligned adjacent one another on a dispenser 126 and further includes two electrostatic charging bars 128, 130 positioned adjacent one another. In the embodiment depicted, the charging bars 128, 130 are in the form of elongated rods with raised circumferential ridges 132, 134 disposed on the rods at angles to the longitudinal axes of the rods to form the point sources and localized electrostatic fields 133, 135, as described above. The charging bars 128, 130 are positioned such that the raised circumferential ridges 132, 134 on the charging bars 128, 130 correspond generally in number and spacing with the liquid dispensing outlets 122, 124 on the dispenser 126. The electrostatic charging bars 128, 130 are connected to an electrostatic power source 136 via electrostatic cables 138, 140 and are coupled to actuators 142, 144 for imparting rotation to the electrostatic charging bars 128, 130 about their longitudinal axes. The electrostatic charging bars 128, 130 may be rotated either in unison or independently to control the placement of liquid material 146, 147 flowing from the corresponding liquid dispensing outlets 122, 124.

As depicted in FIG. 5, each of the rotating charging bars 128, 130 acts as a series oscillating point sources relative to the corresponding fixed liquid dispensing outlets 122, 124 to cause the dispensed liquid material 146, 147 to be deposited on the substrate 148 in an oscillating pattern, as was described above for FIG. 4 and the single row of liquid dispensing outlets 94. In the embodiment depicted in FIG. 5, the spacing of the charging bars 128, 130 and liquid dispensing outlets 122, 124 is configured to cause the successive beads of dispensed liquid material 146, 147 to overlap such that an interlaced sinusoidal pattern is created. When the dispensed liquid material 146, 147 is an adhesive, such a pattern may be desirable to provide for improved bonding of the substrate 148 to a mating surface.

While the present invention has been illustrated by the description of various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. An apparatus for dispensing a bead of liquid material onto a substrate, the apparatus comprising:

a liquid dispensing outlet for dispensing the bead in a first direction;

an electrostatic point source positioned at a distance from said liquid dispensing outlet to define a space for receiving the substrate, said point source mounted for movement relative to said outlet and configured to electrostatically influence the bead dispensed from said outlet into at least a second direction; and an actuator coupled to said point source, said actuator operating to move said point source to move the dispensed bead within said space and control the placement of the dispensed bead on the substrate.

2. The apparatus of claim 1, wherein said actuator is configured to reciprocate said point source back and forth in a direction transverse to the first direction.

3. The apparatus of claim 1, wherein said point source further comprises a rod having a longitudinal axis and a raised projection extending outwardly from said rod, and said actuator is configured to rotate said rod causing said raised projection to rotate about said longitudinal axis.

4. The apparatus of claim 1, wherein said actuator is configured to move said point source in generally an orbital motion relative to said liquid dispensing outlet.

5. An apparatus for dispensing multiple beads of liquid material onto a moving substrate, the apparatus comprising:

a plurality of liquid dispensing outlets;

a plurality of electrostatic point sources capable of electrostatically influencing the beads dispensed from said plurality of liquid dispensing outlets, said plurality of electrostatic point sources spaced from said plurality of liquid dispensing outlets to define a space for receiving the moving substrate, said plurality of point sources mounted for movement relative to said liquid dispensing outlets; and at least one actuator coupled to said plurality of point sources and operating to move said plurality of point sources for moving the dispensed beads within said space and controlling the placement of the dispensed beads on the moving substrate.

6. The apparatus of claim 5, wherein each of said plurality of electrostatic point sources includes an elongated member having a serrated edge, each of said serrations corresponding to one of said electrostatic point sources.

7. The apparatus of claim 5, wherein each of said plurality of electrostatic point sources includes an elongated charging rod having a longitudinal axis, an outer surface and a plurality of raised circumferential ridges spaced along said longitudinal axis, said ridges arranged about said outer surface at respective angles with respect to said longitudinal axis, whereby rotation of said rod about said longitudinal axis causes the beads to be placed on the moving substrate in an oscillating pattern.

8. The apparatus of claim 5, wherein said liquid dispensing outlets are configured to dispense the beads in a first direction and said actuator is configured to reciprocate said plurality of electrostatic point sources back and forth in a direction transverse to the first direction.

9. The apparatus of claim 5, wherein said actuator is configured to move each of said plurality of electrostatic point sources in generally an orbital motion relative to a corresponding one of said liquid dispensing outlets.

10. An apparatus for dispensing multiple beads of liquid material onto a moving substrate, the apparatus comprising:

a first plurality of liquid dispensing outlets;

a second plurality of liquid dispensing outlets proximate said first plurality of liquid dispensing outlets;

a first plurality of electrostatic point sources capable of electrostatically influencing the beads dispensed from said first plurality of liquid dispensing outlets and arranged to correspond to said first plurality of liquid dispensing outlets;

a second plurality of electrostatic point sources capable of electrostatically influencing the beads dispensed from said second plurality of liquid dispensing outlets and arranged to correspond to said second plurality of liquid dispensing outlets;

said first and second pluralities of electrostatic point sources respectively spaced from said first and second liquid dispensing outlets to define a space for receiving the moving substrate; and at least one actuator coupled to said first and second pluralities of electrostatic point sources to move said first and second pluralities of electrostatic point sources and move the dispensed beads within said space and control the placement of the dispensed beads on the moving substrate.

11. The apparatus of claim 10, further comprising a first elongated member for mounting said first plurality of electrostatic point sources and a second elongated member for mounting said second plurality of electrostatic point sources, each of said members having a serrated edge with each serration corresponding to one of said electrostatic point sources.

12. The apparatus of claim 10, further comprising a first elongated charging rod having a first longitudinal axis and a second elongated charging rod having a second longitudinal axis, said first elongated charging rod for mounting said first plurality of electrostatic point sources and said second elongated charging rod for mounting said second plurality of electrostatic point sources, each of said rods having an outer surface with a plurality of raised circumferential ridges arranged at an angle to the respective first or second longitudinal axis of said rod, whereby rotation of each said rod about the respective first or second longitudinal axis urges the liquid material to be placed on the substrate in an oscillating pattern.

13. A method for dispensing at least one bead of liquid material onto a substrate using a liquid dispensing apparatus including at least one liquid dispensing outlet and at least one movable electrostatic point source, the method comprising:

positioning the substrate in a space between the liquid dispensing outlet and the electrostatic point source;

dispensing the bead of liquid material from the outlet;

charging the electrostatic point source to generate a localized electrostatic field and electrostatically influence the bead of liquid material dispensed from the outlet; and moving the electrostatic field relative to the outlet to move the dispensed bead within the space and control the placement of the bead on the substrate.

14. The method of claim 13, wherein the step of moving the electrostatic field further comprises reciprocating the electrostatic point source relative to the liquid dispensing outlet to provide a nonlinear bead pattern on the substrate.

15. The method of claim 13, wherein the step of moving the electrostatic field further comprises moving the electrostatic point source in a generally orbital motion relative to the liquid dispensing outlet to produce an overlapping pattern of dispensed liquid material on the substrate.

16. The method of claim 13, further comprising:

moving the substrate past the outlet while dispensing the bead of liquid material.

17. A method for simultaneously dispensing multiple beads of liquid material onto a substrate using a liquid dispensing apparatus including a plurality of liquid dispensing outlets and a corresponding plurality of electrostatic point sources, the method comprising:

moving the substrate in a space between the liquid dispensing outlets and the electrostatic point sources;

dispensing the beads of liquid material from the respective outlets;

charging the electrostatic point sources to generate localized electrostatic fields and electrostatically influence the beads of liquid material dispensed from the outlet; and moving the electrostatic fields relative to the outlets to move the dispensed beads within the space and control the placement of the beads on the moving substrate.

18. The method of claim 17, wherein the plurality of electrostatic point sources are provided on an elongated rod with a longitudinal axis and the method further comprises:

rotating the rod about the longitudinal axis to move the electrostatic fields relative to the outlets and move the beads within the space and control the placement of the beads on the moving substrate.

19. The method of claim 17, wherein the plurality of electrostatic point sources are provided on an elongated rod with a longitudinal axis and the step of moving the electrostatic fields further comprises:

moving the rod back and forth along the longitudinal axis to move the electrostatic point sources relative to the outlets and move the beads within the space and control the placement of the beads on the moving substrate.

20. The method of claim 19, wherein the step of moving the electrostatic fields further comprises moving the rod back and forth continuously to produce oscillating patterns of the dispensed beads on the substrate.

21. The method of claim 20, wherein the step of moving the electrostatic fields further comprises moving the electrostatic point sources in a generally orbital motion relative to the liquid dispensing outlets to produce overlapping patterns of dispensed beads on the substrate.

* * * * *